United States Patent [19]

Tantalo et al.

[11] 4,223,847

[45] Sep. 23, 1980

[54] COAXIAL FEEDER

[75] Inventors: Lawrence Tantalo, Springfield; Robert H. Traver, Yellow Springs; William E. Lyons, Springfield, all of Ohio

[73] Assignee: The Bauer Bros. Co., Springfield, Ohio

[21] Appl. No.: 956,807

[22] Filed: Nov. 1, 1978

[51] Int. Cl.[3] ..... B02C 7/11

[52] U.S. Cl. ..... 241/247; 241/251

[58] Field of Search ..... 241/245–248, 241/222, 224, 251, 261.2

[56] References Cited

U.S. PATENT DOCUMENTS

| | | | |
|---|---|---|---|
| 3,074,656 | 1/1963 | Christensen et al. | 241/247 |
| 4,082,233 | 4/1978 | Reinhall | 241/247 X |
| 4,132,366 | 1/1979 | Engall | 241/245 |

*Primary Examiner*—Mark Rosenbaum

*Attorney, Agent, or Firm*—Jerome P. Bloom

[57] ABSTRACT

A coaxial feeder for connection to the inlet of a disc refiner includes a channel defining means which contains a bladed screw the blade of which has a relatively short axial length and is housed to position coaxially of the discs, to which it feeds material for refining purposes, and in concentric spaced relation to the wall structure which bounds said channel. The material to be refined is introduced to the down side of the screw blade. At the outer periphery of the blade, at the lowermost limit of its travel, is a bar or plate-like control device which is substantially coextensive with the blade and arranged to specifically direct material to the space between the discs of the related refiner with minimal interference or disruption. The control device presents a surface to the material moved on the down side of the screw blade which effectively inhibits bypass of material to the upside of the blade, having regard for the direction of its rotation in use. The arrangement assures a relatively free backflow of steam from the refiner discs along the upside portion of the blade, to vent to an expansion chamber rising vertically of the screw, which chamber houses means for controlling the inflow of material to the down side of the screw blade in a generally bypassing relation to any significant portion of the backflowing vented steam.

19 Claims, 5 Drawing Figures

COAXIAL FEEDER

BACKGROUND OF THE INVENTION

This invention relates to improved feeding apparatus for a disc refiner. Its features are particularly advantageous for use in a double revolving disc refiner and will be so described, though not necessarily so limited in application.

Feeding of raw materials such as wood chips or pulp to a disc refiner, particularly with a high degree of consistency, has always been a problem, in one way or another. For one thing, the energy applied to the disc refining operation is converted to heat and converts, in turn, the moisture or water present to steam. This steam backflows and interferes with the delivery of material to be refined. The pressure and amount of this backflow is sometimes so great as to completely block the inflow of material to the refiner disc. The disruption of the inflow in this manner, at the least, causes erratic motor loading and wastes energy, as well as has an adverse effect on stock quality. Other problems exist due to the difficulty of properly constructing the apparatus to channel the material fed to the refiner discs in a manner to minimize the adverse effects of backflowing steam.

Much time and money has been put into efforts to solve the above noted problem. There has been a development of various types of "improved" material feeding apparatus with varying degrees of success for some applications. However, the results have not been totally satisfactory. The present day economics of pulp refining demand feeding apparatus that is more versatile and adaptable in application and less prone to misfunction or malfunction than that heretofore offered in the trade.

The present invention materially alleviates the problems heretofore met in feeding disc refiners, particularly double revolving disc refiners, in its provision of an improved coaxial feeder. The feeders of this classification, including art quite remote in contemplation from a feeder for a disc refiner pertinent to the present invention of which those substantively involved in this disclosure are aware, and which have been considered to determine the novelty of the present invention consist of the following publications:

U.S. Pat. Nos. 3,467,323 A. Asplund et al Sept. 16, 1969; 4,082,233 R. B. Reinhall Apr. 4, 1978; 3,074,656 L. N. Christensen et al Jan. 22, 1963; 2,064,666 A. Krushel Dec. 15, 1936; 1,114,657 E. Twigg Oct. 20, 1914; 1,078,517 M. E. Rozelle Nov. 11, 1913; 3,420,458 A. J. Yli-Paavola Jan. 7, 1969.

SUMMARY OF THE INVENTION

Embodiments of the present invention feature apparatus constituting a bladed screw the blade of which has a relatively short axial length and is housed to position coaxially of the discs to which it feeds material for refining purposes. The housing for the bladed feeder is designed to provide that the material to be directed thereby to the associated disc refiner is introduced to the down side of the screw blade. Positioned immediately of the outer periphery of this material moving blade, at the lowermost limit of its travel, is a bar or plate-like control device substantially coextensive in length with the screw blade means. This control device presents to the material advanced by the blade a surface which lends the material a specific direction, causing it to flow to the infeed opening or openings to the space between the discs of the refiner to which the feeder connects with minimal interference or disruption. At the same time the control device is arranged to effectively inhibit such bypass of material to the upside of the bladed screw, having regard for its direction of rotation in use, as might plug, clog or hang up in the material feed channel in which the screw is disposed and unduly load the drive mechanism. A consequence of this latter effect of the control device is that the arrangement assures a relatively free movement of backflowing steam along the upside portion of the screw to vent therefrom to an expansion chamber rising vertically of and from the screw, which chamber houses means for specifically directing material to the down side of the bladed screw in a generally bypassing relation to any significant portion of the so vented, backflowing, steam.

Preferred embodiments of the invention provide that within its relatively short but somewhat extended axial length the screw blade, which is relatively shallow, circumscribes only about 360° of the screw shaft to which it mounts. Moreover, the control device in such embodiments is fixed along the lowermost interior portion of the wall surface which defines the bottom of the channel through which the bladed feed screw extends toward the refiner to which the feeder apparatus connects.

Accordingly, a primary object of the invention is to provide a feeder for a disc refiner which is economical to fabricate, more efficient and satisfactory in use, adaptable to a wide variety of applications and unlikely to cause malfunction or misfunction.

Another object is to alleviate the problems of dealing with backflowing steam in operating and feeding disc refiners.

A further object is to render disc refiners, particularly double revolving disc refiners much cheaper to operate, from the standpoint of applied energy, more highly productive per unit time and/or capable of producing more uniformly controlled and higher quality end products.

An additional object is to provide a coaxial feeder and component arrangements thereof, particularly advantageous for use with a double revolving disc refiner, possessing the advantageous structural features, the inherent meritorious characteristics and means and mode of use rendered obvious and/or deriving from the embodiment hereinafter described or its equivalent.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein one but not necessarily the only form of the embodiment of the invention is illustrated, FIG. 1 is a longitudinal sectional view of a double revolving disc refiner embodying in connection therewith coaxial feeding apparatus in accordance with the present invention;

Figure 3:
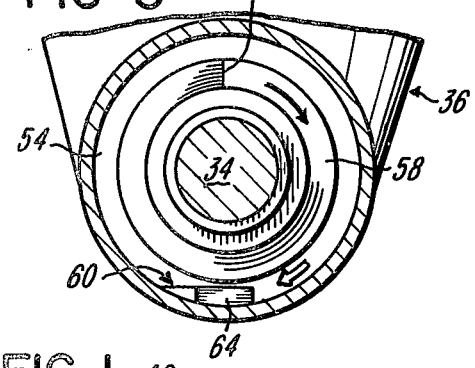
FIG. 3 is a sectional view taken on line 3—3 of FIG. 1.
Figure 4:
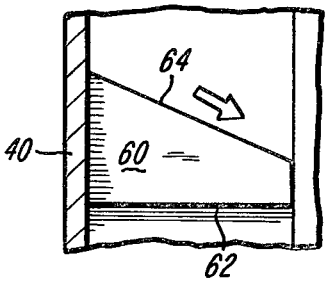
FIG. 4 is a fragmentary view taken on line 4—4 of FIG. 1.

The embodiment of the drawings is diagrammatically illustrated and detailed only to the extent as may be necessary to enable one versed in the art to fully understand the invention.

As shown, a case 10 contains the infeed disc 12 and the outboard disc 14 of a double revolving disc refiner. The opposed faces of the discs each mount a conventional annular arrangement of refiner plates, respectively 16 and 18, on its outer periphery and these plates 16 and 18, which are arranged in an opposed closely spaced relation, rim what constitutes the eye 20 of the refiner. The infeed disc 12 includes conventional infeed passages 22 rimmed at the disc infeed face 24, immediately about their outer peripheral limits, by a narrow, flat, annular ring-shaped plate 26. The latter is seated to a recessed shoulder surface 28. The surface of the plate 26 which faces outermost of the infeed disc is positioned in a very closely spaced relation to the inwardly projected end of a ring element 30 which is fixed to line the refiner inlet opening 32 at the center of one side of the case 10. The arrangement is such that, as the infeed disc rotates, the ring 26 forms an operative seal with the adjacent end of the ring 30.

The disc 12 is fixed on one end of a drive shaft 34 which projects inwardly of the case 10 through the center of the inlet opening 32 and outwardly through the lower end of an upwardly expanding chute-like structure 36. In transverse section the bottom of the structure 36 is uniformly arcuate about the longitudinal axis of the shaft 34 to a plane which is parallel to and immediately below the horizontal plane of the longitudinal axis of the shaft. Upwardly from this plane, in transverse section, the sides of the structure 36 continuously diverge to form with a side wall portion 38 immediately adjacent the case 10 and a side wall 40 remote therefrom an expansion chamber 42.

The structure 36 and its chamber 42 are perpendicular to the shaft 34. The lowermost portions of their side walls 38 and 40 are parallel and include coaxial apertures. The one of these apertures in the side wall 38 has its bottom portion rimmed by an axial extension of the interior wall surface at the bottom of the structure 36 and it is formed on the same radius. This aperture in the wall 38 is also rimmed by a short cylindrical projection 39 integral with and perpendicular to the outer surface of the wall 38 which also forms an axial extension of the uniformly arcuate wall portion at the bottom of the structure 36.

Figure 1:
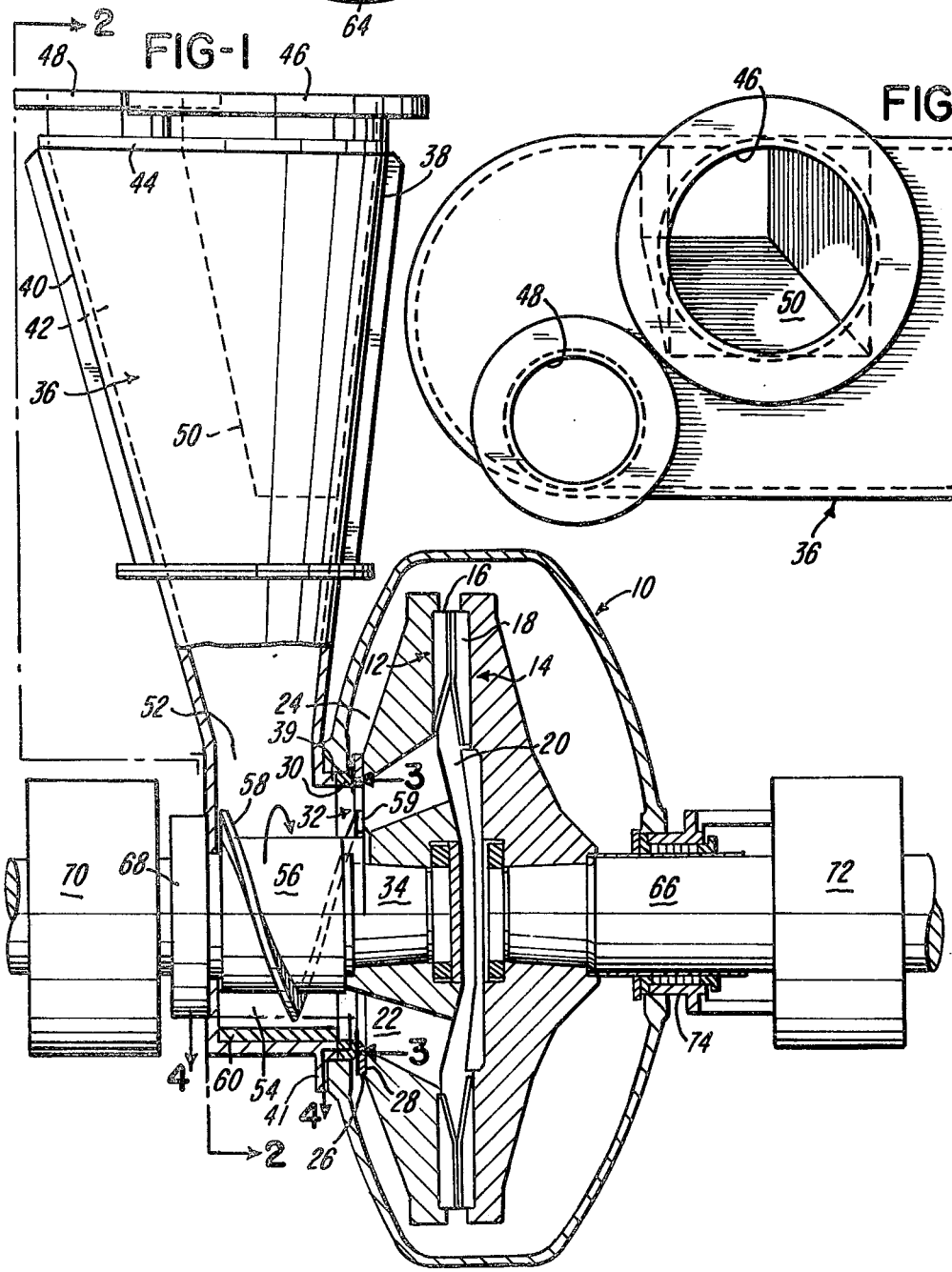
Figure 5:
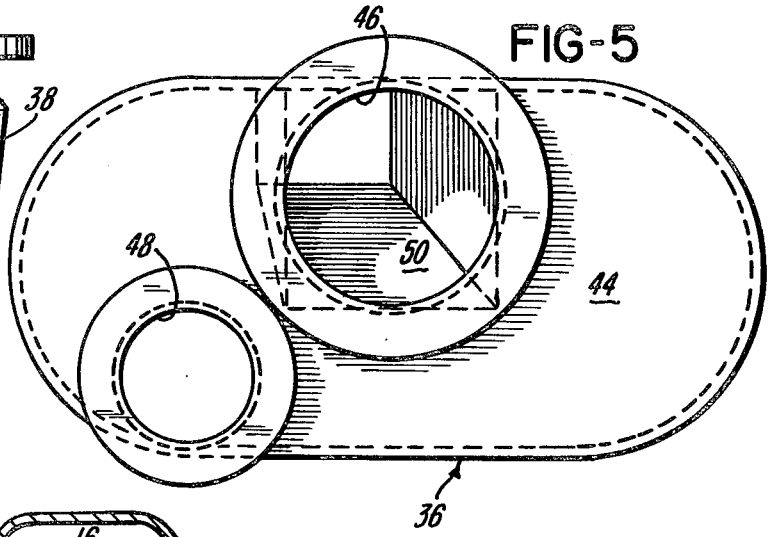
FIG. 5 is a top view of the portion of the structure of FIG. 1 defining an expansion and material inlet passage to the coaxial feeding apparatus for the disc refiner there illustrated.
Figure 2:
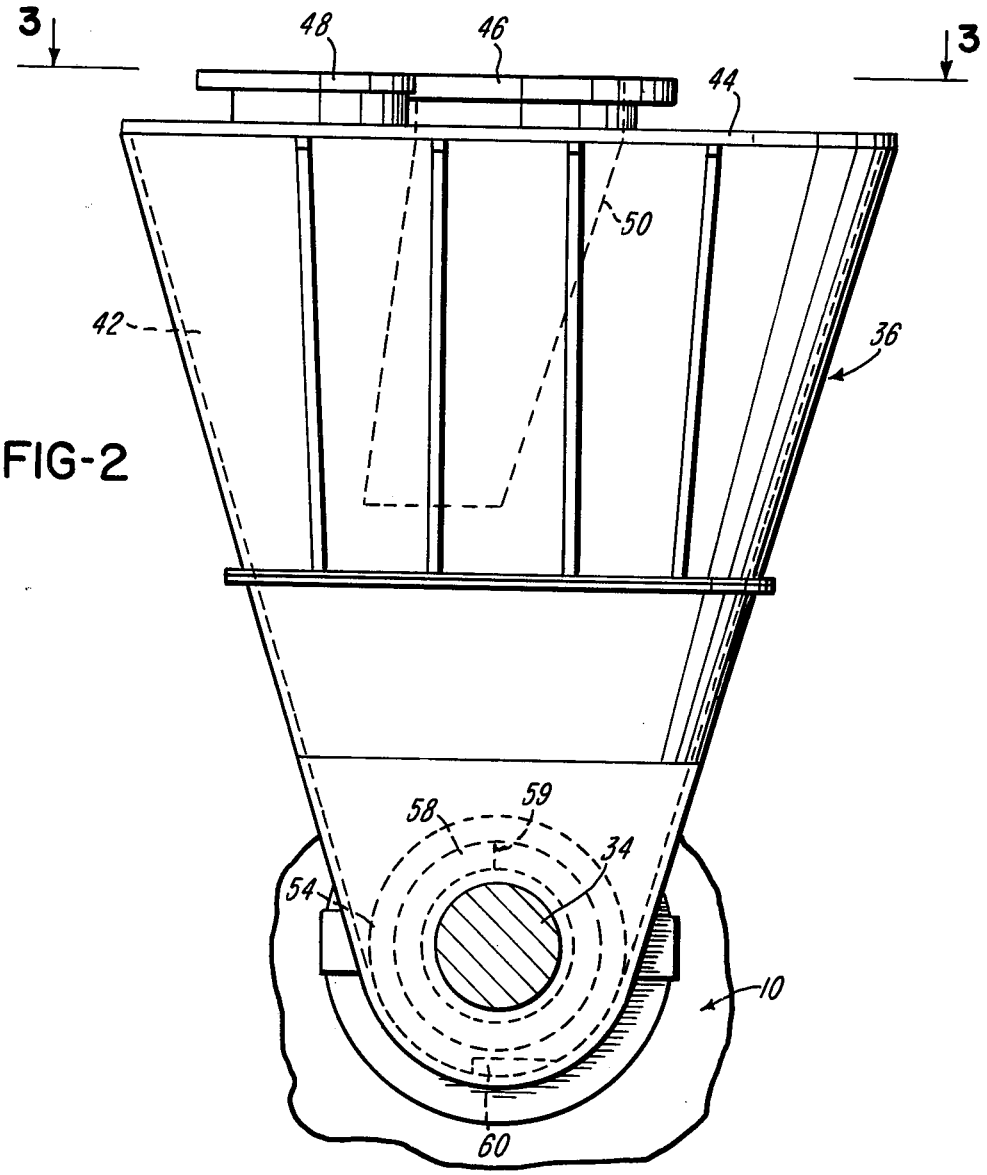
FIG. 2 is an end elevation view taken in the direction of line 2—2 of FIG. 1.

As seen in FIG. 1, in assembly of the structure 36 to the case 10, the cylindrical projection 39 is inserted in the inlet opening 32 to end abut and provide an axial extension of the ring 30, its inner wall surface being dimensioned to align with that of the ring 30. Flange means 41 embodied in connection with the side wall 38 and its cylindrical projection 39 are arranged to abut and form a seal with complementarily formed surface portions of the case 10 about the inlet opening 32. The other of the coaxial apertures in the side wall 40 is formed on a radius only very slightly larger than that of the shaft 34 which projects therethrough to have its outermost end portion connect with its drive motor (not shown). Seated to a recessed shoulder in the outer surface of the wall 40, and providing a bearing surface for the shaft 34 which projects therethrough, is an assembly 68 forming a seal between the shaft and the wall 40. Immediately outward of the seal 68 the shaft 34 passes through and is supported by a bearing housing 70 based on and supported in turn by the underlying base support of the case 10 and the shaft drive motor. Conventional outboard bearing support for the shaft 34 is also provided.

The bottom portion of the structure 36, including the coaxial cylindrical projection 39, provides an infeed channel 54 leading to and coaxial with the refiner inlet opening 32. The cross sectional configuration and size of this channel provides that its peripheral limits, axially extended by the rings 30 and 26, immediately bound the outer peripheral limits of the entrances to the infeed passages 22 in the disc 12.

The downward convergence of the structure 36 to its lower channel forming bottom portion, the ends of which channel are defined by the parallel lower end portions of the side walls 38 and 40, including the projections 39, provides in the structure 36 a necked chute portion 52. The chute portion 52 is immediately above the channel and the upper level of the projection 39 and provides an infeed opening to the channel.

Within the channel 54 the shaft 34 mounts thereabout, in fixed relation thereto, a sleeve 56. One end of sleeve 56 is adjacent and in closely spaced relation to the wall 40 and its other end extends to a vertical plane which intercepts an immediate portion of the length of the ring 30. The axial extent of the sleeve 56 is not only coextensive with that of channel 54 but projects beyond, within and in concentric spaced relation to ring 30, and a portion of this projected end is axially extended to abut a recessed surface portion of the hub of the disc 12 defined by a cutaway in its outermost face 24.

Fixed to and wrapped around the sleeve 56 in a helical configuration, to project peripherally and circumscribe approximately 360° as it extends from one end of the sleeve to the other, is a shallow continuous blade 58 which forms therewith, and the drive shaft 34, a feed screw. The blade 58 has, essentially, a single turn and an extended though relatively short axial length. The one end of the blade presents a wiping edge surface immediately adjacent the wall 40 and the other presents a similar wiping edge 59 which in rotation of the shaft 34 sweeps a circular path which overlaps that area swept by the radially innermost portion of the entrances to the infeed passages 22. The end of the blade 58 including the edge 59 abuts a surface portion of the face 24 of the infeed disc 12 which lies between a pair of adjacent circularly spaced infeed passages 22, and locates on the extension of sleeve 56 which reaches the disc 12. The outer peripheral limit of blade 58 lies within and spaced from the outer peripheral limits of the channel 54.

The lowermost projected limit of the blade 58 places it in spaced relation to the bottom interior wall surface portion of the channel 54 which corresponds to the lowermost portion of the interior wall surface of the structure 36. Fixed to and in laterally centered relation to the bottom surface of channel 54, the length thereof, is a plate 60 serving as a control device. One end of plate 60 is flush abutted to the bottom of wall 40 while the other, which is shorter in transverse width, is positioned slightly beyond the center of the lowermost portion of the cylindrical projection 39 at the outermost face of side wall 38, having regard to the direction of rotation of shaft 34 in use. The described ends of plate 60 are parallel, though differing in transverse width. One side edge of plate 60 which extends between its ends positions beyond and parallel to the line in the bottom interior surface of channel 54 which defines the lowermost limit of the channel while the opposite side edge 64, having regard for shaft rotation, is inclined in a longitudinal sense and so positioned that a point centered between its ends will approximately coincide with a point in the line defining the lowermost interior surface portion of channel 54. As will be seen, in drive thereof the blade 58 will have its lowermost limit move immediately of the upper surface of plate 60, with only so much clearance therebetween as to prevent interference with its rotation. In use, the edge surface 64 of plate 60 provides an effective partition blocking passage of material from the down side of the blade 58, immediately outward thereof, from moving past the plate 60 to the upside of the blade movement. The effect of this will be further described.

The structure 36 and its expansion chamber 42 is capped at its uppermost limit by a horizontal cover plate 44. The plate 44 incorporates means defining an inlet opening 46 which is adjacent and laterally centered in reference to the wall 38. It also incorporates a smaller outlet opening 48 offset toward one lateral extremity thereof. The tubular means rimming the inlet opening 46 is continued inwardly and downwardly of the expansion chamber by a hopper-like structure 50 which is adjacent, at its discharge extremity, the side wall 38 and inclined so its discharge opening at its discharge extremity is directed to the down side of the blade 58 in drive thereof on use of the coaxial feeder. Thus, the hopper 50, the discharge opening of which is angled towards the down side of the blade 58 to communicate therewith by way of the down side portion of the infeed opening 52, and primarily in an area located intermediate the axial limits of the blade 58, is so directed as to leave, relatively clear, a portion of the infeed opening 52 to and through which steam vented from the refiner by way of the infeed passages 22 and the upside of the blade 58 may pass without significant interference. Above the infeed opening 52 the configuration of the expansion chamber 42 enables the vented steam to quickly expand and follow the path of least resistance to the outlet 48, without perceptible interference with or disruption of the free flow of the material introduced by way of the hopper 50.

In use of the above described apparatus the material to be refined is delivered, in chip, pulp or other suitable form, by way of the inlet opening 46. From the opening 46 the material falls in a smooth and accelerating free flow, by way of hopper 50, and the infeed opening 52, to the down side of the rotating blade 58. The blade 58 picks up this free flowing material primarily at its outer peripheral portion and quickly advances it to and through the channel 54, including the discharge end defined by the projection 39, to the infeed disc 12. By virtue of the control plate 60 and the partition defined by its edge surface 64, the material will in the course of its advance by the blade 58 be moved to the bottom of channel 54 and outwardly of the blade along the edge 64. The angle of the surface 64 will insure a controlled guiding of the material approaching the surface 64 along the bottom of the channel and in the direction of the position that the radially outermost portion of the entrance to each infeed opening 22 will assume in the course of the rotation of the infeed disc 12. The arrangement insures that the feed of material to and through the delivery passages 22 fully utilizes the natural forces of gravity and centrifugal force. The fact that the material enters the outermost portions of the radial limits of the passages 22 facilitates the fluid movement of the material through these passages and the delivery thereof to the eye 20 of the refiner at a most efficient angle. Further, the edge 59 at the infeed face of the disc 12 moves in a path to further control the direction of the material as it is advanced to the infeed passages 22 and inhibits undesirable buildup in the vicinity of the entrances to the feed passages 22.

In the course of the feeder operation, as previously described, the control plate 60 by the angle of its edge 64 on the bottom surface of channel 54 not only directs movement of material but facilitates its movement, giving it a natural progression while inhibiting the material which it blocks from passing to the upside of the blade 58.

Important in preferred embodiments of the invention is the limitation of the axial length of the blade 58 and the spread of its ends which dictate that the time dwell of material in the channel 54 is absolutely minimal. Significant also is the fact that tests have shown that the feed is so smooth by reason of the primary and effective use of the outer peripheral portions of the blade 58. Contributing to the freedom of material flow to and through the disc 12 is the fact that it moves through the infeed opening 52 to the down side of the blade 58 in an area relatively centered between the ends of the 360° axial extent of the blade. This seems to avoid choking.

Use of the invention embodiment illustrated has shown that there is relatively a minor amount of material reaching the upside of the blade 58 and for this reason steam backflowing from the eye of the refiner finds a quick and easy passage from the refiner by way of the inlet opening 32 and the up side of the blade 58 to vent relatively clear of incoming material by way of the infeed opening 52, at the up side thereof, and into and through the expanding chamber 42, to escape by way of the outlet 48, at which point it may be recaptured for further use.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. In combination with a disc refiner wherein one disc rotates relative another with their disc refining surfaces in an opposed relatively closely spaced relation, said refiner having an inlet thereto, one of said discs being an infeed disc positioned adjacent said inlet and having at least one passage for delivery therethrough of the material to be refined, received by way of said inlet and passing therefrom to the space between the opposed refining surfaces, and said infeed disc being connected to and driven by a shaft, infeed apparatus comprising means connecting to the inlet of the disc refiner defining a channel aligning with the inlet and accommodating the projection therethrough of said drive shaft, continuous blade means connecting with and projected from said shaft at the end of the shaft immediately preceding the face of said infeed disc and control means positioned within said channel at the outer peripheral limit of said blade means to direct material moved by said blade means to enter the related disc refiner and said delivery passage of its infeed disc in an area substantially coinciding with a predetermined position of the delivery passage during rotation of said infeed disc.

2. Apparatus as in claim 1 wherein said control means is connected with said means defining said channel and extends substantially coextensive with the length of said channel and at the down side of the movement of said blade means, having regard for the direction of rotation of said blade means on rotation of said drive shaft.

3. Apparatus as in claim 1 wherein said channel is defined by means constructed and arranged to connect to the inlet of said refiner so as to cause said channel to extend in a sense coaxially of said infeed disc, said channel means has an opening limited to the top thereof for infeed of material to said blade means for delivery to the infeed disc and said one delivery passage thereof and an opening limited to one end defined by means including an inner wall surface thereof which is formed to extend to rim the path of travel of the outer peripheral limit of said one passage during rotation of the infeed disc in the refiner to which said channel means is applied.

4. Apparatus as in claim 1 wherein said channel and said blade means are substantially coextensive in length.

5. Apparatus as in claim 1 wherein said blade means includes a helical blade means constituting a solid flight the length of which is arranged to circumscribe substantially 360° of the circumference of the shaft to which it is applied.

6. Apparatus as in claim 1 wherein said blade means is constructed as a shallow blade means as far as its projection from said shaft and its end which positions adjacent the face of the infeed disc has a radial extent and position providing that it is adapted to sweep a circular path which overlaps that area swept by the radially innermost portion of said delivery passage on rotation of said infeed disc.

7. Apparatus as in claim 1 wherein said control means is a bar or plate-like member arranged to intercept material delivered to said blade means and induce movement thereof along the lower portion of the down side of the travel of said blade means, having regard for the rotation thereof in use.

8. Apparatus as in claim 1 wherein said control means is a bar or plate-like element which presents to the material moving on the down side of the rotation of said blade means an inclined surface.

9. Apparatus as in claim 8 wherein said inclined surface intercepts and crosses a line defining substantially the lowermost portion of the interior wall surface of said means defining said channel to direct the material leaving the lowermost portion of the down side of said blade means to flow into the inlet of the related refiner and into the entrance end of the delivery passage in its infeed disc substantially at the lowermost position of its travel during rotation thereof.

10. Apparatus as in claim 1 wherein a feed opening to said means defining said channel is at the upper side of said channel and in connection therewith embodies means defining a material inlet passage arranged to direct material to said feed opening and to deliver it thereby to an area limited to the down side of said blade means in the course of its rotation.

11. Apparatus as in claim 10 wherein said feed opening is at the lower end of an outwardly and upwardly directed wall structure defining an expansion chamber in advance of said channel and said expansion chamber embodies in connection therewith said material inlet passage which constrains material fed therethrough to move to the down side of the blade means in the course of rotation thereof.

12. Apparatus as in claim 1 wherein said control means is constructed and arranged to limit movement of material fed to and by said blade means to the down side of said blade means, having regard for the direction of its rotation and to block material on the inner wall surface of the means defining said channel from a direct continuation of its movement on said surface beyond said control means, the construction and arrangement providing means to facilitate the escape of steam backflowing from between the discs in the related refiner by way of a portion of said channel at the up side of said blade means.

13. Apparatus according to claim 12 wherein said channel opens at its top to a duct-like structure extending generally perpendicular to the longitudinal axis of said blade means and forming an upwardly expanding chamber embodying means for infeed of material to the down side of said blade means and an exit for steam backflowing from between the discs of the related refiner, in bypassing relation thereto.

14. Apparatus as in claim 1 characterized in that said blade means is constructed and arranged to wrap around the shaft to which it is applied and includes a base portion for fixing thereof to the shaft and relatively projected helical blade means constituting a solid flight the length of which is arranged to circumscribe the shaft to which it is applied to the extent of substantially 360° of its circumference.

15. A disc refiner installation comprising a housing, a pair of refiner discs within said housing one of which rotates relative the other with their disc refining surfaces in an opposed relatively closely spaced relation, said housing having an inlet thereto, said one of said discs being an infeed disc positioned adjacent said inlet, said infeed disc including a plurality of delivery passages which are circularly spaced, said infeed disc being connected to and driven by a shaft for rotation thereof, means defining a channel in connection with said housing through which said shaft extends to said infeed disc, continuous blade means connected with and projected from said shaft at the end thereof immediately preceding said infeed disc and control means positioned within said channel, said control means being constructed and arranged to substantially limit the path of material moved to said refiner by said blade means for refining so that such material is directed to the lowermost portion of said infeed disc, having regard for its orientation in use, and to cause the material to move into each of said delivery passages in the course of substantially its lowermost position during rotation of said infeed disc.

16. In combination with a disc refiner wherein at least one refining disc rotates relative another, in an opposed adjacent relation thereto, said refiner having an inlet thereto for the material to be refined to pass to said discs for refining, means defining a channel constructed and arranged to connect to the inlet of the refiner, said channel defining means accommodating therein a shaft connected to and for rotation of one of said discs, blade means on said shaft locating adjacent and extending substantially to the end of said channel connecting to the refiner inlet and control means positioned within said channel, outwardly of said blade means, to locate substantially along the portion of the interior surface of said means defining the channel which positions lowermost in use, said control means being so constructed and arranged to direct the material advanced by said blade means to said inlet as to enter and pass through the inlet adjacent the lowermost limit thereof.

17. Apparatus as in claim 16 wherein said means defining said channel has an opening arranged to direct material to said blade means, for delivery to and through the connected inlet, so as to enter said blade means in the area constituting the down side thereof on rotation thereof in use.

18. Apparatus as in claim 17 wherein said means defining said channel has a chute-like structure in connection therewith which extends upwardly thereof and generally perpendicular to said shaft and in communication therewith through said opening and said control means is constructed and arranged to inhibit material coming in contact therewith from moving thereby from the down side to the up side of the rotational movement of said shaft.

19. Infeed apparatus as in claim 16 wherein said blade means is a helical blade means constituting a solid flight the length of which is such to circumscribe substantially 360° of the circumference of said shaft.

* * * * *

UNITED STATES PATENT AND TRADEMARK OFFICE

CERTIFICATE OF CORRECTION

PATENT NO. : 4,223,847

DATED : September 23, 1980

INVENTOR(S) : Lawrence Tantalo; Robert H. Traver; and William E. Lyons

It is certified that error appears in the above-identified patent and that said Letters Patent are hereby corrected as shown below:

Col. 4, line 20, "jections" is corrected to read -- jection --.

Signed and Sealed this

*Thirtieth* Day of *December 1980*

[SEAL]

*Attest:*

SIDNEY A. DIAMOND

*Attesting Officer*

*Commissioner of Patents and Trademarks*